US006536221B2

(12) United States Patent
James

(10) Patent No.: US 6,536,221 B2
(45) Date of Patent: Mar. 25, 2003

(54) AIR CONDITIONING HEAT RECOVERY ARRANGEMENT

(76) Inventor: Norbert L. James, 3409 Hibiscus Pl., Miramar, FL (US) 33023-4929

( * ) Notice: Subject to any disclaimer, the term of this patent is extended or adjusted under 35 U.S.C. 154(b) by 0 days.

(21) Appl. No.: 09/760,141

(22) Filed: Jan. 16, 2001

(65) Prior Publication Data

US 2002/0092311 A1 Jul. 18, 2002

(51) Int. Cl.[7] ..... F25B 27/00; F25B 39/04
(52) U.S. Cl. ..... 62/238.6; 62/183
(58) Field of Search ..... 62/238.6, 238.7, 62/183

(56) References Cited

U.S. PATENT DOCUMENTS

| | | | | |
|---|---|---|---|---|
| 3,976,123 A | | 8/1976 | Davies | |
| 4,199,955 A | | 4/1980 | Jonsson | |
| 4,399,664 A | * | 8/1983 | Derosier | 62/238.7 |
| 4,423,602 A | * | 1/1984 | Venable | 62/238.6 |
| 4,658,594 A | | 4/1987 | Langford | |
| 4,680,941 A | * | 7/1987 | Richardson et al. | 62/184 |
| 4,770,001 A | * | 9/1988 | Kittler | 62/238.6 |
| 5,050,394 A | * | 9/1991 | Dudley et al. | 62/115 |
| 5,228,505 A | * | 7/1993 | Dempsey | 165/140 |
| 5,560,216 A | | 10/1996 | Holmes | |
| 5,673,567 A | * | 10/1997 | Dube | 62/117 |
| 5,778,696 A | * | 7/1998 | Conner | 62/238.6 |
| 5,901,563 A | | 5/1999 | Yarbrough et al. | |
| 5,906,104 A | | 5/1999 | Schwartz et al. | |
| 6,082,125 A | | 7/2000 | Savtchenko | |
| 6,109,050 A | * | 8/2000 | Zakryk | 62/238.6 |
| 6,263,964 B1 | * | 7/2001 | Yang | 165/300 |

* cited by examiner

*Primary Examiner*—William C. Doerrler
(74) *Attorney, Agent, or Firm*—Oltman, Flynn & Kuble

(57) ABSTRACT

In combination with a residential air conditioning system and a water fixture with a water recirculation loop, such as a swimming pool, a refrigerant-to-water heat exchanger having a tank with water inlet and outlet connections to said water recirculation loop, and a condenser coil with refrigerant inlet and outlets for connection respectively to the compressor and the condenser of the air conditioning system. Whenever the air conditioning system comes on, a control circuit turns on the pump independent of the usual timer and connects the refrigerant-to-water heat exchanger inlet to the compressor of the air conditioning system.

11 Claims, 1 Drawing Sheet

AIR CONDITIONING HEAT RECOVERY ARRANGEMENT

FIELD OF THE INVENTION

This invention relates to a heat recovery arrangement used with a residential air conditioning system to heat the water for a swimming pool, spa, water heater or other water fixture by heat transfer from the hot refrigerant at the outlet side of the usual compressor of the air conditioning system.

PRIOR ART

Various arrangements have been proposed heretofore for heating the water of a swimming pool, spa, water heater or other water fixture in a coaxial refrigerant-to-water heat exchanger connected to the outlet of the compressor of an air conditioning system. Examples of such arrangements are disclosed in the following U.S. patents: Davies U.S. Pat. No. 3,976,123, Jonsson U.S. Pat. No. 4,199,955, Langford U.S. Pat. No. 4,658,594, Holmes U.S. Pat. 5,560,216, Yarborough et al U.S. Pat. No. 5,901,563, Schwartz et al U.S. Pat. No. 5,906,104, and Savtchenko U.S. Pat. No. 6,082,125.

Also, Langford U.S. No. Pat. 4,658,594 discloses a combined air conditioning and pool heater system in which recirculated pool water is heated by air drawn across an electric heater by the A/C system's evaporator fan.

SUMMARY OF THE INVENTION

The present invention is directed to a novel and simplified arrangement of a refrigerant-to-water heat exchanger connected to a residential air conditioning system to use the hot refrigerant coming from the A/C system's compressor to heat the water for a swimming pool, spa, water heater or other water fixture at the residence.

The heat exchanger in the present invention comprises a water tank with water inlet and outlets that may be readily connected in the water recirculation loop of swimming pool or spa, and a condenser coil of the type used in residential air conditioning systems in heat transfer relationship to the water in the tank. This condenser coil has a refrigerant inlet and a refrigerant outlet that may be readily connected to the air conditioning system at the outlet side of its compressor.

With this simplified arrangement, no great expertise is required to make the water connections and the refrigerant connections of the refrigerant-to-water heat exchanger without significant change to the air conditioning system or the water recirculation system which this heat exchanger serves.

This and other advantageous characteristics of the present invention will be apparent from the following detailed description of two present preferred embodiments thereof, shown in the accompanying drawings.

DETAILED DESCRIPTION OF THE INVENTION

Before explaining the present invention in detail it is to be understood that the invention is not limited in its application to the particular arrangements shown and described since the invention is capable of other embodiments. Also, the terminology used herein is for the purpose of description and not of limitation.

A typical home air conditioning system has an evaporator inside the house which receives cold refrigerant and across which air is drawn by a fan to supply cool air to the residential areas, a compressor outside the house for taking gaseous refrigerant from the evaporator outlet and compressing it into a hot liquid, an air cooled condenser outside the house connected to the compressor outlet for cooling the liquid refrigerant, and an expansion valve connected between the condenser outlet and the evaporator inlet to cause the cooled liquid refrigerant to cool even more before entering the evaporator.

A typical outdoor swimming pool has a water recirculation loop with a pump and a filter for continuously withdrawing water from the pool, filtering it, and sending the filtered water back into the pool.

Figure 1:
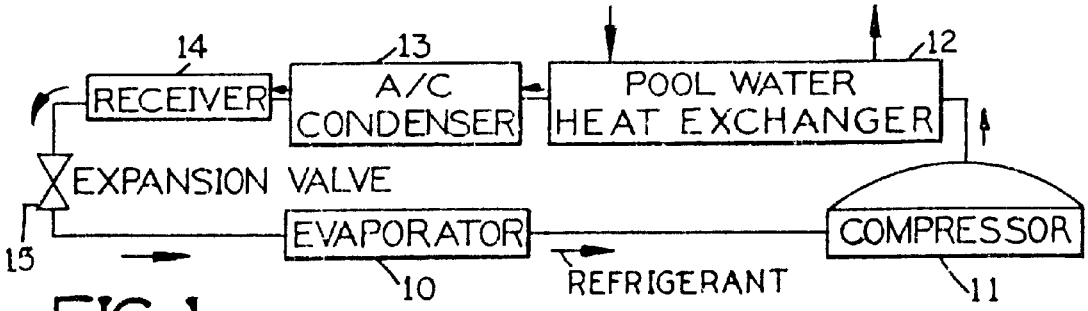
FIG. 1 is a block diagram of a single air conditioning system and a pool water heat exchanger in accordance with the present invention.

Referring to FIG. 1, a complete single unit air conditioning and pool water heating arrangement in accordance with this invention comprises an evaporator 10 having its output connected to the inlet of a compressor 11. The compressor outlet is connected to the inlet of a pool water heat exchanger 12 in which the hot refrigerant gives up heat to the pool water and is partially cooled by it. The outlet of the heat exchanger is connected to the inlet of a condenser 13 in the air conditioning system. Here the refrigerant is cooled further before being passed to a liquid receiver 14, and from there through an expansion valve 15 to the inlet of evaporator 10, completing the refrigeration cycle loop. Suitable electrical controls and valves (not shown) are provided to control the refrigeration cycle as directed by a thermostat (not shown) inside the house or other residence in a known manner.

Figure 2:
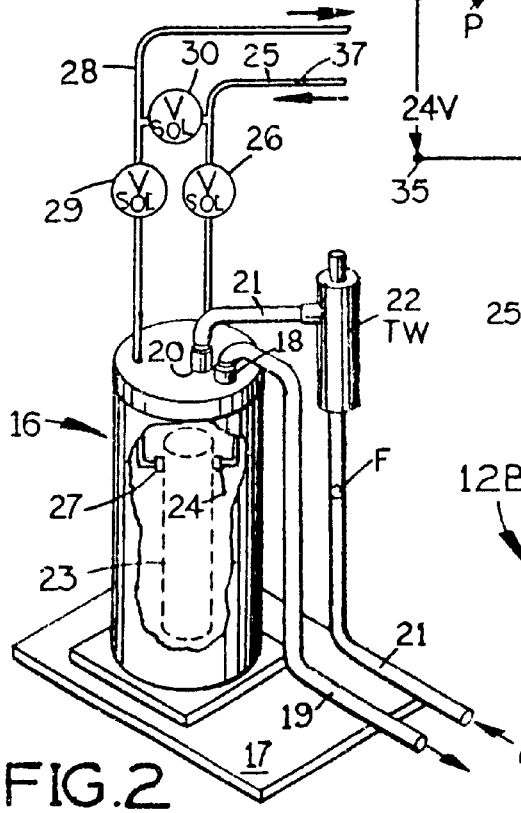
FIG. 2 is a schematic perspective view of the heat exchanger tank in the FIG. 1 system, partly broken open to show the condenser coil inside, and its refrigerant and water connections.

Referring to FIG. 2, in accordance with the present invention the refrigerant-to-water heat exchanger 12 comprises a heat-insulated, sealed, cylindrical water tank 16 mounted on a horizontal platform 17 of plywood or the like. At the top the tank has a water outlet at 18 to which a PVC outlet pipe 19 is attached in water-tight fashion, and a water inlet at 20 to which a similar water inlet pipe 21 is attached. A normally-open flow switch F in the water inlet line 21 to heat exchanger 12 is operative to close when pool water flows to the heat exchanger. A thermostat well 22 is positioned in the water inlet line 21 near the top of the water tank.

Water tank 16 receives an air conditioner condenser coil 23 of known design, preferably a helically wound tube of corrosion resistant titanium that withstands the usual chlorine in the recirculated pool water. Condenser coil 23 has a refrigerant inlet at 24 connected to a refrigerant pipe 25 through a normally-closed first solenoid valve 26. This condenser coil has a refrigerant outlet at 27 which is connected to an outlet pipe 28 having a normally-closed second solenoid valve 29. A normally-open third solenoid valve 30 is connected between the refrigerant inlet line 25 and the refrigerant outlet line 28 at the upstream side of solenoid valve 26 in inlet line 25 and the downstream side of solenoid valve 29 in outlet line 28. A normally closed high pressure switch 37 in the refrigerant inlet line 25 to heat exchanger 12 is operative to close when the refrigerant pressure in this line, coming from compressor 11 (FIG. 1), exceeds a predetermined safe value.

The refrigerant-to water heat exchanger 12 operates as follows:

When the pool pump is off and pool water is not being recirculated, the refrigerant bypasses heat exchanger 12 by way of the normally-open solenoid valve 30, which passes the refrigerant from inlet line 25 directly to the outlet line 28 leading to the inlet of the condenser 13 of the residential air conditioning system. Under these conditions, solenoid valve 26 is in its normally-closed condition and it blocks the refrigerant in inlet line 25 from the inlet side of condenser coil 23 in the refrigerant-to-water heat exchanger 12, and the normally-closed solenoid valve 29 blocks the refrigerant from flowing down into the outlet side of condenser coil 23 by way of the normally-open third solenoid valve 30. When the pool pump is on, the solenoids of valves 26, 29 and 30 are energized, valves 26 and 29 are open, and valve 30 is closed. Consequently, the refrigerant flows into and through the condenser coil 23 of heat exchanger 12 and through solenoid valve 29 to the inlet of the A/C condenser 13.

Figure 3:
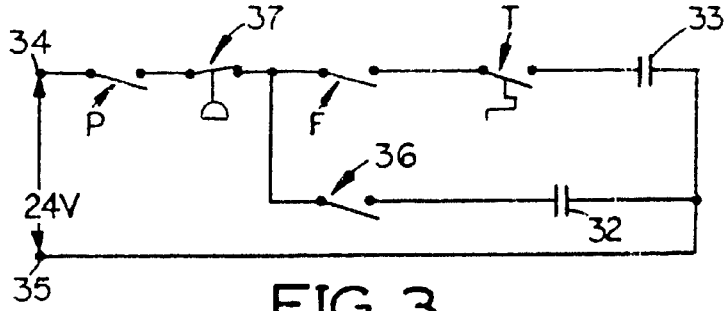
FIG. 3 is a schematic circuit diagram showing the electrical controls for the pool pump and the heat exchanger in this system.

In the usual home air conditioning system a thermostatic control turns on the air conditioner whenever the temperature in the home exceeds a predetermined level, and the flow of refrigerant closes a normally-open pressure switch. FIG. 3 shows such a pressure switch at P.

In the most common swimming pool water recirculation systems the motor of the pool pump is under the control of a timer which the user typically sets to keep the pool pump off for several hours at night, when it is not needed. The present invention has an electrical control for turning on the pool pump, even if the timer is scheduled to keep it off, whenever the residential air conditioning system comes on.

Referring to FIG. 3, the energization of the pool pump's motor is under the control of pool pump contactor 32, and the energization of the solenoids of valves 26, 29 and 30 (FIG. 2) for the refrigerant-to-water heat exchanger 12 in FIG. 1 is under the control of solenoid valves contactor 33. The air conditioning system's pressure switch P and the high pressure switch 37 control the power supply to both sets of contactors 32 and 33 from 24 volt power supply terminals 34 and 35.

Pressure switch P and high pressure switch 37 are connected through a manually operated toggle switch 36 to the pump contactor 32. Toggle switch 36 may be set to a closed position for automatic heating of the pool water whenever the air conditioning is on, as sensed by pressure switch P.

Pressure switch P and high pressure switch 37 are connected through the previously mentioned flow switch F (FIG. 2) and a thermostat T to the solenoid valves contactor 33. Thermostat T senses the temperature of the pool water, and it closes the energization circuit to the solenoid valves contactor when the pool water temperature drops to a predetermined value, and opens this energization circuit when the pool water temperature is too high. Flow switch F closes in response to the flow of pool water to the refrigerant-to-water heat exchanger 12.

The high pressure switch 37 is normally closed but when the pressure of refrigerant coming from compressor 11 (FIG. 1) exceeds a safe value it opens automatically to turn off the pool pump motor and also de-energize the solenoid valves 26, 29 and 30 so as to bypass refrigerant from the heat exchanger 12 for safety reasons.

Accordingly, in the absence of such an excessively high refrigerant pressure, if the timer has turned off the pool pump's motor and the pool water temperature is low enough to close the switch contacts of thermostat T, when the air conditioning system comes on and pressure switch P closes: (1) the pool pump contactor 32 is connected to the 24 volt power supply through the toggle switch 36; and (2) the solenoid valves contactor 33 is connected to the power supply through flow switch F and thermostat T. Consequently, the pool pump is turned on to deliver water to the tank 16 of heat exchanger 12, and solenoid valves 26 and 29 are opened, and solenoid valve 30 is closed, so that refrigerant flows through the condenser coil 23 of exchanger 12, as described.

Figure 4:
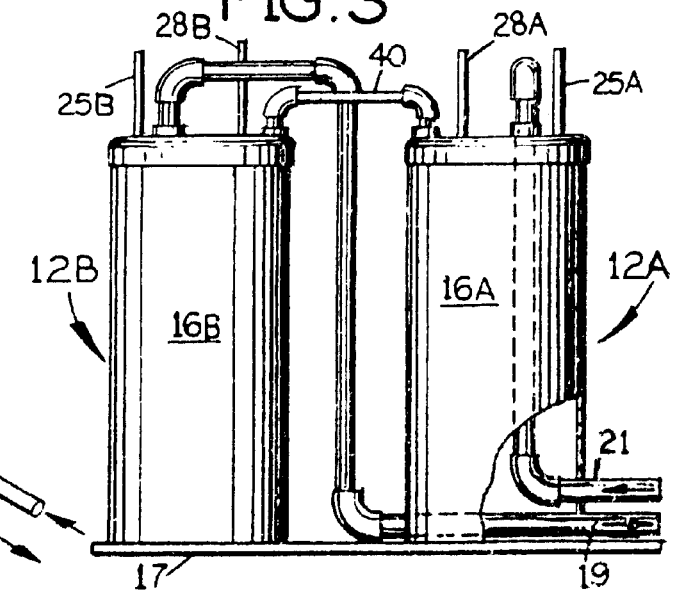
FIG. 4 is a view corresponding to FIG. 2 of a dual heat exchanger system for use with a dual house air conditioning system and a single pool water recirculation loop.

FIG. 4 shows two refrigerant-to-water heat exchangers 12A and 12B for a system in accordance with a second embodiment of this invention, which is for use at a home or other site having two air conditioning systems for different parts of the house. Elements of the two heat exchanger system shown in FIG. 4 that correspond to those of the single heat exchanger system of FIG. 2 are given the same reference numerals so that the detailed description of these elements need not be repeated. Suffixes A and B are provided to distinguish one heat exchanger of the two from the other.

The first heat exchanger 12A in FIG. 4 has a water tank 16A connected to at water inlet line 21 supplied with water from the pool pump, a helically wound condenser coil (not shown) inside this tank, and inlet and outlet refrigerant lines 25A and 25B connected to opposite ends of this condenser coil. Line 25A receives refrigerant from the compressor of a first A/C system in the house and passes it to the condenser coil inside tank 16A, and line 28A passes this refrigerant from the condenser coil inside tank 16A to the usual condenser in the first A/C system. Tank 16A has a water outlet connected by a water conduit 40 to the water inlet of a second water tank 16B. Tank 16B holds a helically wound condenser coil (not shown) whose opposite ends are connected respectively to a refrigerant inlet line 25B and a refrigerant outlet line 28B. Line 25B receives refrigerant from the compressor of a second A/C system in the house and passes it to the condenser coil inside tank 16B, and line 28B passes refrigerant from the condenser coil in tank 16B to the condenser of the second A/C system in the house. Tank 16B has a water outlet connected to a water outlet line 19 leading back to the swimming pool.

Because the pool water passes serially through the two tanks, first through 16A and then through 16B, it will be heated by the refrigerant from whichever A/C system in the house is on. And if both house A/C systems are on, a refrigerant-to-water heat exchange will take place in both tanks 16A and 16B.

Figure 5:
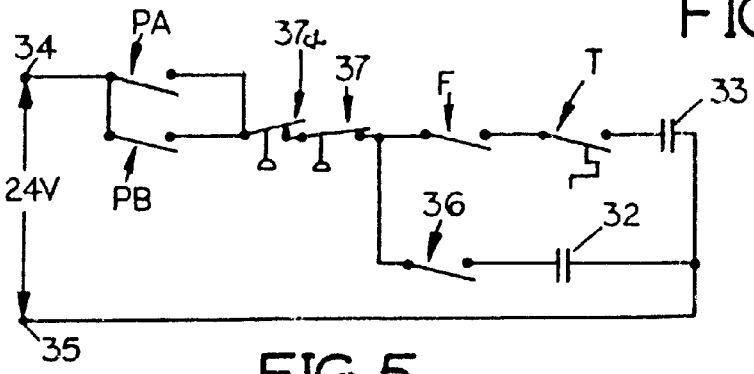
FIG. 5 is a circuit diagram showing the electrical controls for this dual system.

FIG. 5 illustrates schematically the electrical control circuit in the dual heat exchanger embodiment of the present invention. Again, corresponding elements are given the same reference numerals as in FIG. 3.

The embodiment of FIG. 5 differs from that of FIG. 3 only in that there are two pressure switches PA and PB and two high pressure switches 37 and 37*a* instead of just one. The switches PA and PB are connected in parallel with each other so that if either is closed the energization circuit for the pool pump contactor 32 and the solenoid valves contactor 33 is enabled. Thus, if either house A/C system is on, the corresponding heat exchanger 12A or 12B can operate. Switches 37 and 37*a* are high pressure switches for tanks 16A and 16B and are in series.

From the foregoing description, taken in conjunction with the accompanying drawings, it will be evident that each of the disclosed arrangements of the present invention constitutes a simple to install, highly effective apparatus for combining a conventional residential air conditioning system with the water recirculation loop of a water fixture, such as a swimming pool, to heat the pool water and improve the effectiveness of the air conditioning system by using the pool water to recover heat from its hot refrigerant coming out of the air conditioning system's compressor.

I claim:

1. In combination with an air conditioning system having a refrigerant compressor, a condenser, an expansion valve, and an evaporator, and a water-recirculating fixture having a water recirculation loop with a pump therein for withdrawing water from said fixture and returning it to said fixture, the improvement which comprises: a refrigerant-to-water heat exchanger in said recirculation loop comprising an insulated water tank having a water inlet connected to receive water from said water-recirculating fixture and a water outlet connected to pass water to said water-recirculating fixture; and a condenser coil positioned in said tank in heat exchange relationship with the water therein, said condenser coil of said heat exchanger having a refrigerant inlet for receiving hot refrigerant from said compressor and a refrigerant outlet for passing the refrigerant from said heat exchanger to said condenser of the air conditioning system after heating the water in said tank; a normally-closed first solenoid valve connected between said compressor and said refrigerant inlet; a normally-closed second solenoid valve connected between said refrigerant outlet and said condenser of the air conditioning system; a normally-open third solenoid valve connected between the upstream side of said first solenoid valve and the downstream side of said second solenoid valve; and means for energizing said first, second and third solenoid valves to open said first and second solenoid valves and close said third solenoid valve when said air conditioning system comes on.

2. The combination of claim 1 and further comprising: means for turning on said pump when said air conditioning system comes on.

3. In combination with an air conditioning system having a refrigerant compressor, a condenser, an expansion valve, and an evaporator, and a water-recirculating fixture having a water recirculation loop with a pump therein for withdrawing water from said fixture and returning it to said fixture, the improvement which comprises: a refrigerant-to-water heat exchanger in said recirculation loop comprising an insulated water tank having a water inlet connected to receive water from said water-recirculating fixture and a water outlet connected to pass water to said water-recirculating fixture; a condenser coil positioned in said tank in heat exchange relationship with the water therein, said condenser coil of said heat exchanger having a refrigerant inlet for receiving hot refrigerant from said compressor and a refrigerant outlet for passing the refrigerant from said heat exchanger to said condenser of the air conditioning system after heating the water in said tank; and means for blocking said refrigerant inlet of the refrigerant-to-water heat exchanger from said compressor when said air conditioning system is off.

4. In combination with an air conditioning system having a refrigerant compressor, a condenser, an expansion valve, and an evaporator, and a water-recirculating fixture having a water recirculation loop with a pump therein for withdrawing water from said fixture and returning it to said fixture, the improvement which comprises: a refrigerant-to-water heat exchanger in said recirculation loop comprising an insulated water tank having a water inlet connected to receive water from said water-recirculating fixture and a water outlet connected to pass water to said water-recirculating fixture; a condenser coil positioned in said tank in heat exchange relationship with the water therein, said condenser coil of said heat exchanger having a refrigerant inlet for receiving hot refrigerant from said compressor and a refrigerant outlet for passing the refrigerant from said heat exchanger to said condenser of the air conditioning system after heating the water in said tank; a timer operatively connected to said pump to control its operation; and means for turning on said pump independent of said timer whenever said air conditioning system is on.

5. The combination of claim 4 and further comprising: means for blocking said refrigerant inlet of the refrigerant-to-water heat exchanger from said compressor when said air conditioning system is off and for connecting said refrigerant inlet to said compressor when said air conditioning system is on.

6. In combination with an air conditioning system having a refrigerant compressor, a condenser, an expansion valve, and an evaporator, and a water-recirculating fixture having a water recirculation loop with a pump therein for withdrawing water from said fixture and returning it to said fixture, the improvement which comprises: a refrigerant-to-water heat exchanger in said recirculation loop having a water inlet connected to receive water from said fixture, a water outlet connected to pass water to said fixture, and a refrigerant receiver in heat exchange relationship with the water in said heat exchanger, said refrigerant receiver of said heat exchanger having a refrigerant inlet for receiving hot refrigerant from said compressor and a refrigerant outlet for passing the refrigerant from said heat exchanger to said condenser of the air conditioning system after heating the water in said heat exchanger; and means for blocking said refrigerant inlet of the refrigerant-to-water heat exchanger from said compressor when said air conditioning system is off.

7. The combination of claim 6 and further comprising:

a timer operatively connected to said pump to control its operation;

and means for turning on said pump independent of said timer whenever said air conditioning system is on.

8. In combination with an air conditioning system having a refrigerant compressor, a condenser, an expansion valve, and an evaporator, and a water-recirculating fixture having a water recirculation loop with a pump therein for withdrawing water from said fixture and returning it to said fixture, the improvement which comprises: a refrigerant-to-water heat exchanger in said recirculation loop comprising an insulated water tank having a water inlet connected to receive water from said water-recirculating fixture and a water outlet connected to pass water to said water-recirculating fixture; a condenser coil positioned in said tank in heat exchange relationship with the water therein, said condenser coil of said heat exchanger having a refrigerant inlet for receiving hot refrigerant from said compressor and a refrigerant outlet for passing the refrigerant from said heat exchanger to said condenser of the air conditioning system after heating the water in said tank; a second air conditioning system having a refrigerant compressor, a condenser, an expansion valve, and an evaporator; and a second refrigerant-to-water heat exchanger comprising a second insulated water tank having a water inlet connected to said outlet of said first-mentioned tank to receive water therefrom and a water outlet connected in said recirculation loop, and a second condenser coil positioned in said second tank in heat exchange relationship with the water therein, said condenser coil of said second heat exchanger having a refrigerant inlet for receiving hot refrigerant from said compressor of said second air conditioning system and a refrigerant outlet for passing the refrigerant to said condenser of said second air conditioning system after heating the water in said second tank.

9. The combination of claim 8 wherein said second refrigerant-to-water heat exchanger comprises:

a normally-closed first solenoid valve connected between said compressor of said second air conditioning system and said refrigerant inlet of said second tank;

a normally-closed second solenoid valve connected between said refrigerant outlet of said second tank and said condenser of said second air conditioning system;

a normally-open third solenoid valve connected between the upstream side of said first solenoid valve of said second heat exchaanger and the downstream side of said second solenoid valve of said second heat exchanger;

and means for energizing said first, second and third solenoid valves of said seond heat exchanger to open said first and second solenoid valves and close said third solenoid valve when said second air conditioning system comes on.

10. The combination of claim 8 and further comprising:

a timer operatively connected to said pump to control its operation;

and means for turning on said pump independent of said timer whenever either said first-mentioned or said second air conditioning system is on.

11. The combination of claim 9 and further comprising:

a timer operatively connected to said pump to control its operation;

and means for turning on said pump independent of said timer whenever either said first-mentioned or said second air conditioning system is on.

* * * * *